US010612253B2

(12) United States Patent
Yamakawa

(10) Patent No.: US 10,612,253 B2
(45) Date of Patent: Apr. 7, 2020

(54) CONSTRUCTION METHOD FOR REINFORCING A COLUMN AND REINFORCING STRUCTURE FOR A COLUMN

(71) Applicant: SANYOHOME CO., LTD., Ushiku-shi, Ibaraki (JP)

(72) Inventor: Hiroshi Yamakawa, Ushiku (JP)

(73) Assignee: SANYOHOME CO., LTD., Ibaraki (JP)

( * ) Notice: Subject to any disclaimer, the term of this patent is extended or adjusted under 35 U.S.C. 154(b) by 0 days.

(21) Appl. No.: 15/571,622

(22) PCT Filed: Jun. 9, 2015

(86) PCT No.: PCT/IB2015/054339
§ 371 (c)(1),
(2) Date: Nov. 3, 2017

(87) PCT Pub. No.: WO2016/198913
PCT Pub. Date: Dec. 15, 2016

(65) Prior Publication Data

US 2018/0142482 A1 May 24, 2018

(51) Int. Cl.
*E04G 23/02* (2006.01)

(52) U.S. Cl.
CPC ..... *E04G 23/0218* (2013.01); *E04G 23/0225* (2013.01); *E04G 2023/0251* (2013.01)

(58) Field of Classification Search
CPC ..... E04G 23/0218; E04G 23/0225; E04G 2023/0251; E04G 23/0203; E04G 23/02
(Continued)

(56) References Cited

U.S. PATENT DOCUMENTS 5,218,810 A * 6/1993 Isley, Jr. ..... E04C 3/34 52/834
5,633,057 A * 5/1997 Fawley ..... B29C 53/562 428/36.1

(Continued)

FOREIGN PATENT DOCUMENTS

JP 9 177334 7/1997
JP 10-159027 6/1998

(Continued)

OTHER PUBLICATIONS

Official Action for related Japanese Application No. 2013-255234.

(Continued)

*Primary Examiner* — Brian E Glessner
*Assistant Examiner* — Adam G Barlow
(74) *Attorney, Agent, or Firm* — Renner, Otto, Boisselle & Sklar, LLP

(57) ABSTRACT

A construction method for reinforcing a column comprises the steps of: disposing a steel plate 3 around the column subjected to reinforcement 10; and wrapping a reinforcement sheet 8 impregnated with an adhesive on an outer surface of the steel plate 3. A sheet impregnated with an adhesive is fabricated in advance such that an amount of adhesive with which the reinforcement sheet 8 is impregnated is 250 g/m2 to 350 g/m2, and the reinforcement sheet is then carried into a construction site. A reinforcing structure of a column comprises: a steel plate 3 disposed around the column 10 subjected to reinforcement; and a reinforcement sheet 8 impregnated with an adhesive, the sheet being wrapped around a plurality of times on an outer surface of the steel plate 3.

9 Claims, 9 Drawing Sheets

(58) Field of Classification Search
USPC ..... 52/311.2, 514, 514.5
See application file for complete search history.

(56) References Cited

U.S. PATENT DOCUMENTS

| | | | | |
|---|---|---|---|---|
| 6,098,351 | A * | 8/2000 | Mills | E04H 12/2292 52/169.14 |
| 9,085,915 | B1 * | 7/2015 | Emmett | E04H 12/2292 |
| 2009/0165404 | A1 | 7/2009 | Choi | |
| 2014/0245695 | A1 * | 9/2014 | Arnold | E04C 5/012 52/831 |
| 2015/0345159 | A1 * | 12/2015 | Yamakawa | E04G 23/0225 52/514.5 |
| 2018/0142482 | A1 * | 5/2018 | Yamakawa | E04G 23/0218 |

FOREIGN PATENT DOCUMENTS

| | | | |
|---|---|---|---|
| JP | 10 231627 | | 9/1998 |
| JP | 2004-027714 | | 1/2004 |
| JP | 2005 23745 | A | 1/2005 |
| JP | 2006 219951 | A | 8/2006 |
| JP | 2007 146588 | | 6/2007 |
| JP | 2008 63744 | | 3/2008 |
| JP | H11 34198 | A | 2/2009 |
| JP | 2011 236618 | A | 11/2011 |
| JP | 2011236618 | A * | 11/2011 |
| JP | 2013 181332 | | 9/2013 |
| JP | 2014 111865 | | 6/2014 |
| JP | 2014-136923 | | 7/2014 |
| JP | 5641530 | | 11/2014 |
| JP | 2015 34434 | | 2/2015 |
| JP | 2015-113599 | | 6/2015 |
| WO | WO 2008/029794 | A1 | 3/2008 |
| WO | WO 2014/111851 | A1 | 7/2014 |

OTHER PUBLICATIONS

Official Action for related Japanese Application No. 2015-116975.
Second Official Action for related Japanese Application No. 2015-116975.
Sato et al., Experimental Study on Steel Board Rolling Reinforcement for RCE Elevated Bridge Column, Annual Conference of the Japan Society of Civil Engineers, vol. 51, 1996, pp. 1056-1057, and English abstract.
International Search Report for related International Application No. PCT/IB2015/054339 dated Dec. 9, 2015.
Examination Report No. 1 for related Australian Application No. 2015398068 dated Sep. 4, 2018.
Official Action for related Canadian Application No. 2,984,861 dated Oct. 15, 2018.
Examination Report for corresponding Australian Application No. 2015398068 dated Jul. 15, 2019.
Office Action for corresponding Canadian Application No. 2,984,861 dated Jun. 17, 2019.
Official Action for corresponding Japanese Application No. 2016-151972 dated Jun. 6, 2019, and a partial English translation.

* cited by examiner

[Fig. 1]
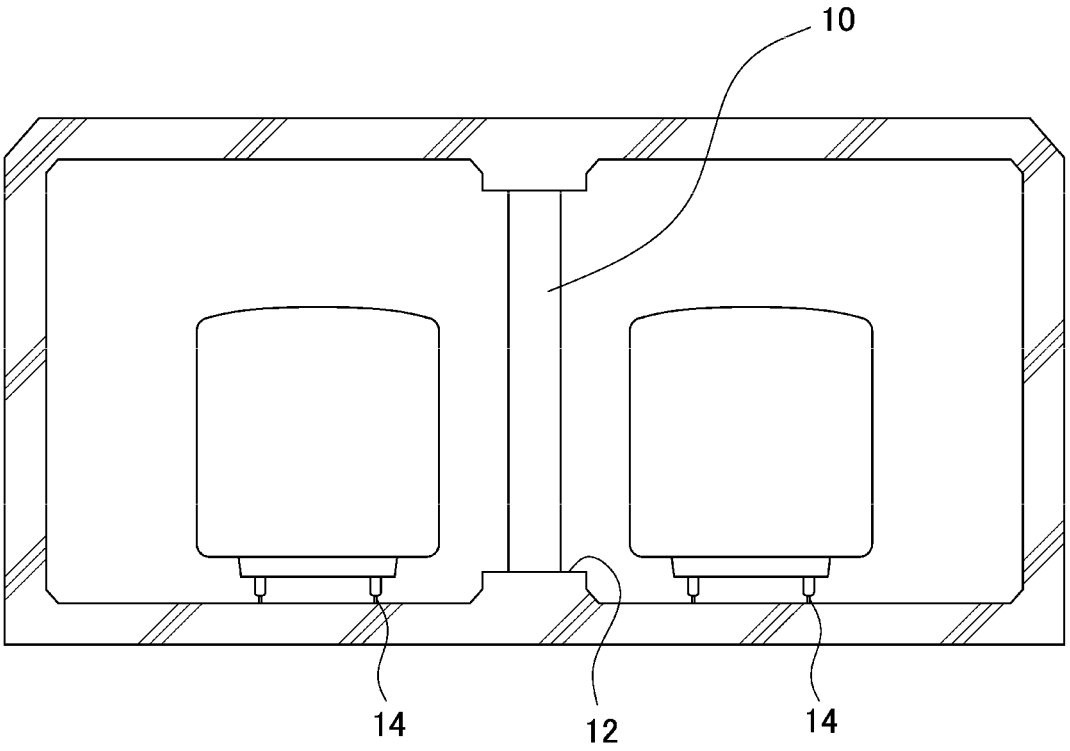
[Fig. 2]
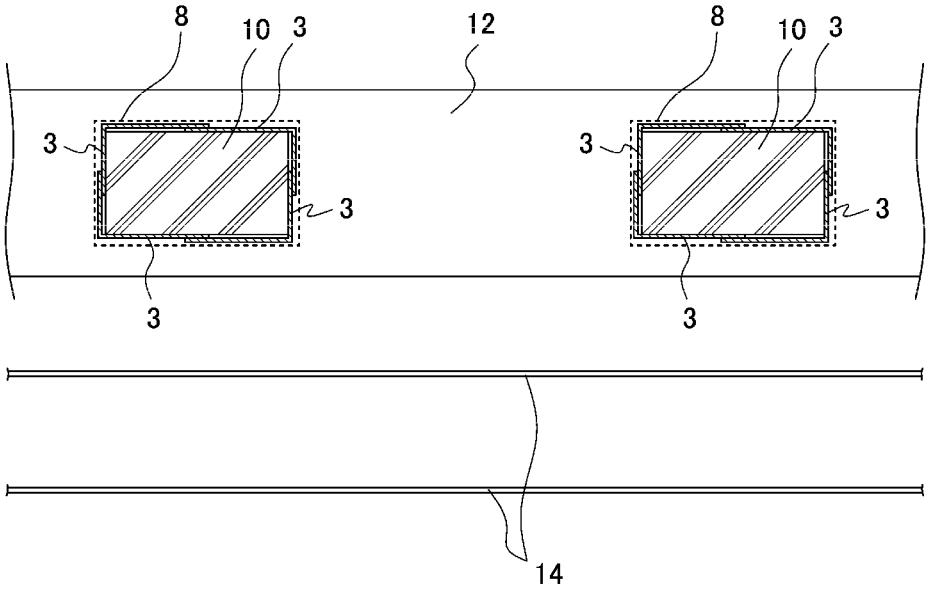

[Fig. 3]
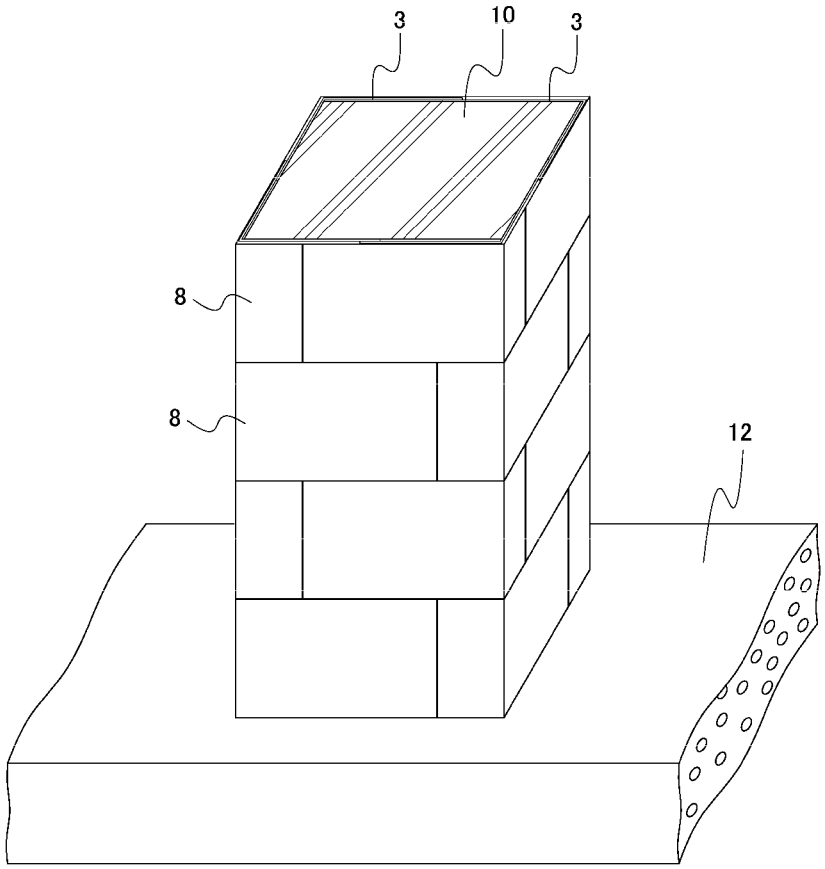
[Fig. 4]
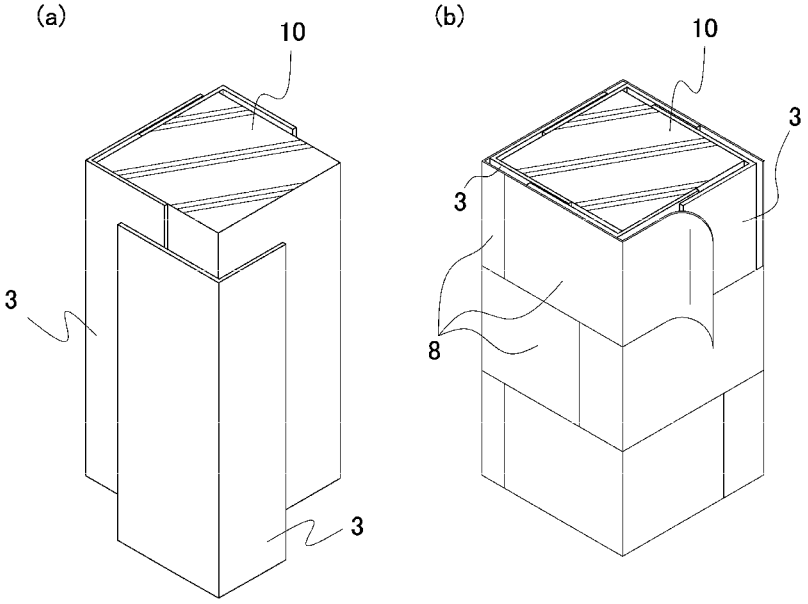

[Fig. 5]
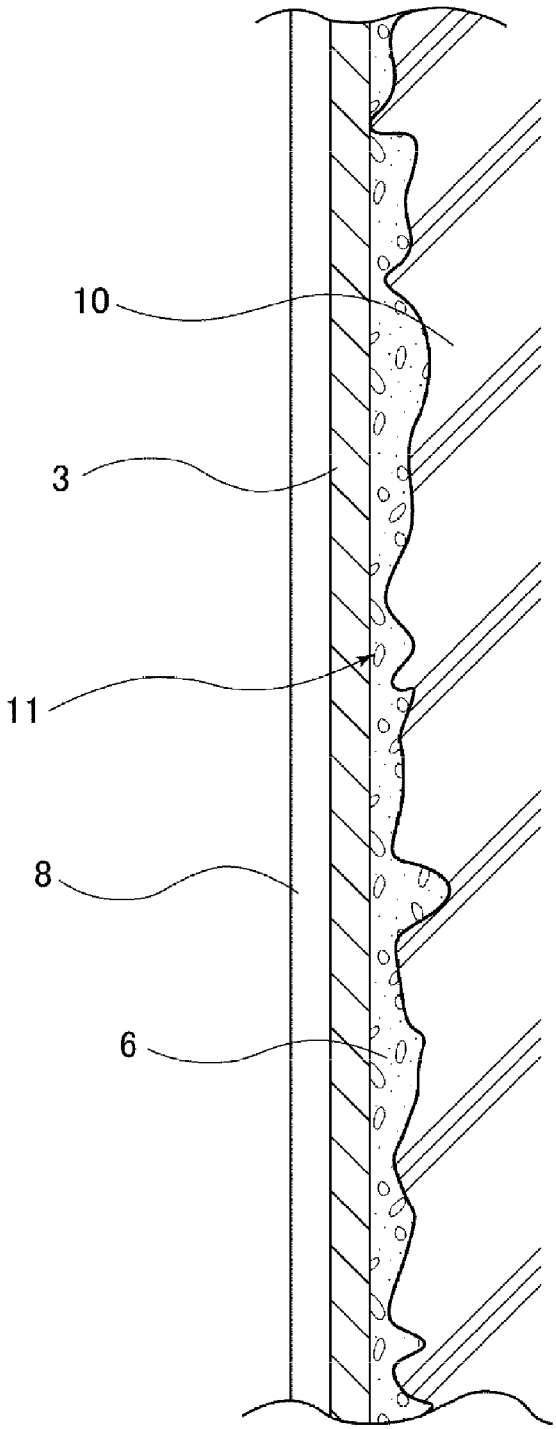

[Fig. 6]
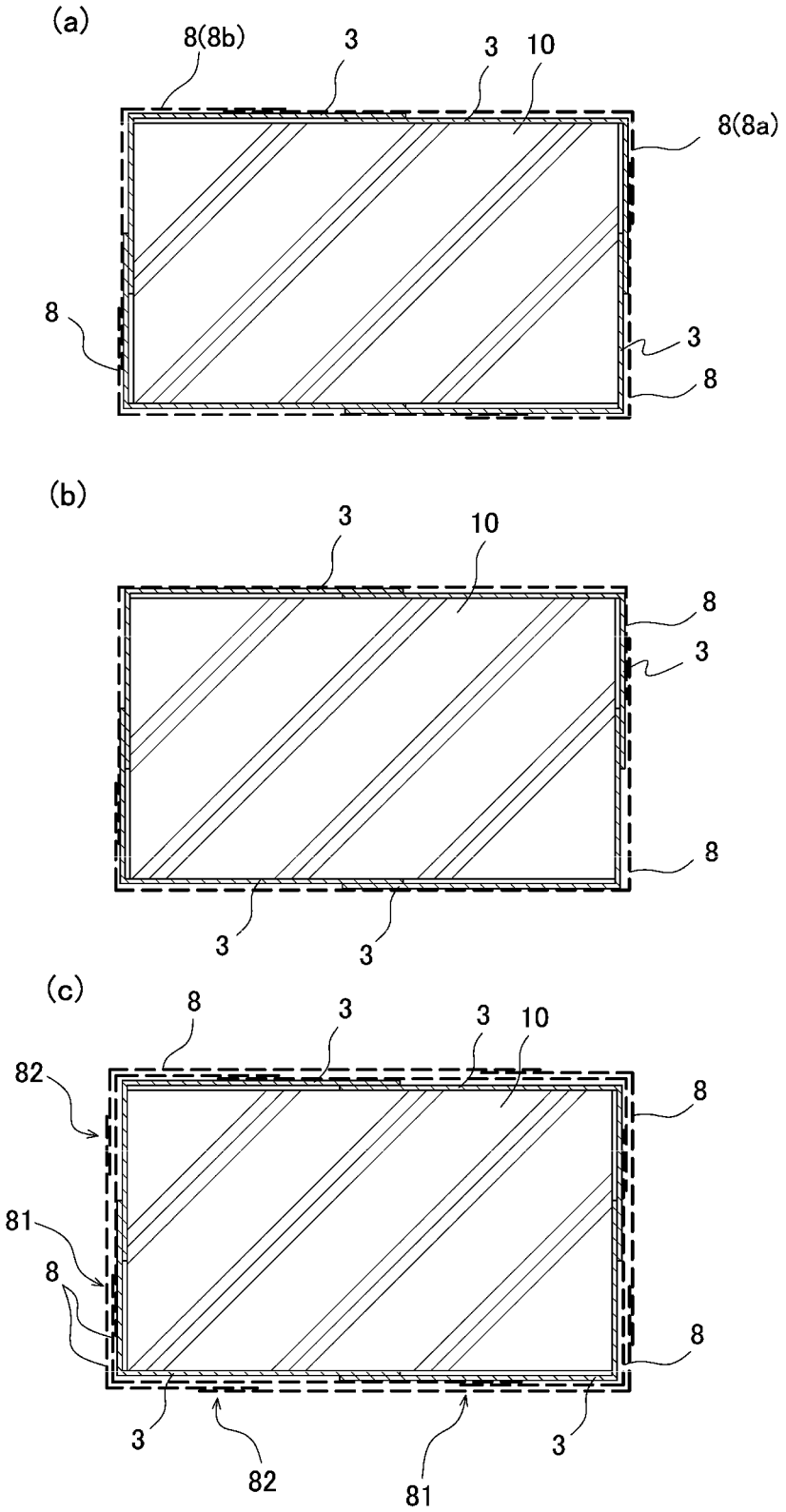

[Fig. 7]
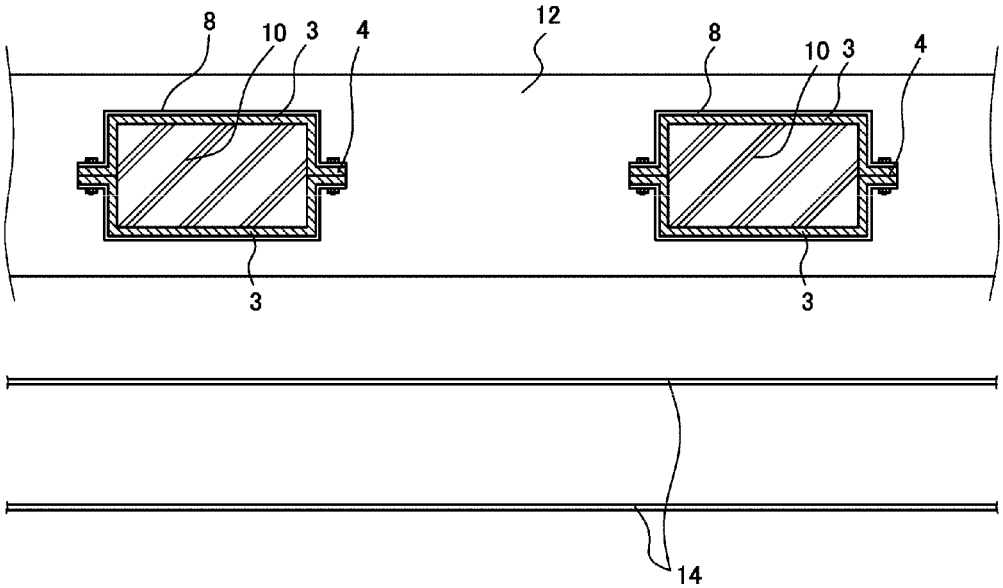
[Fig. 8]
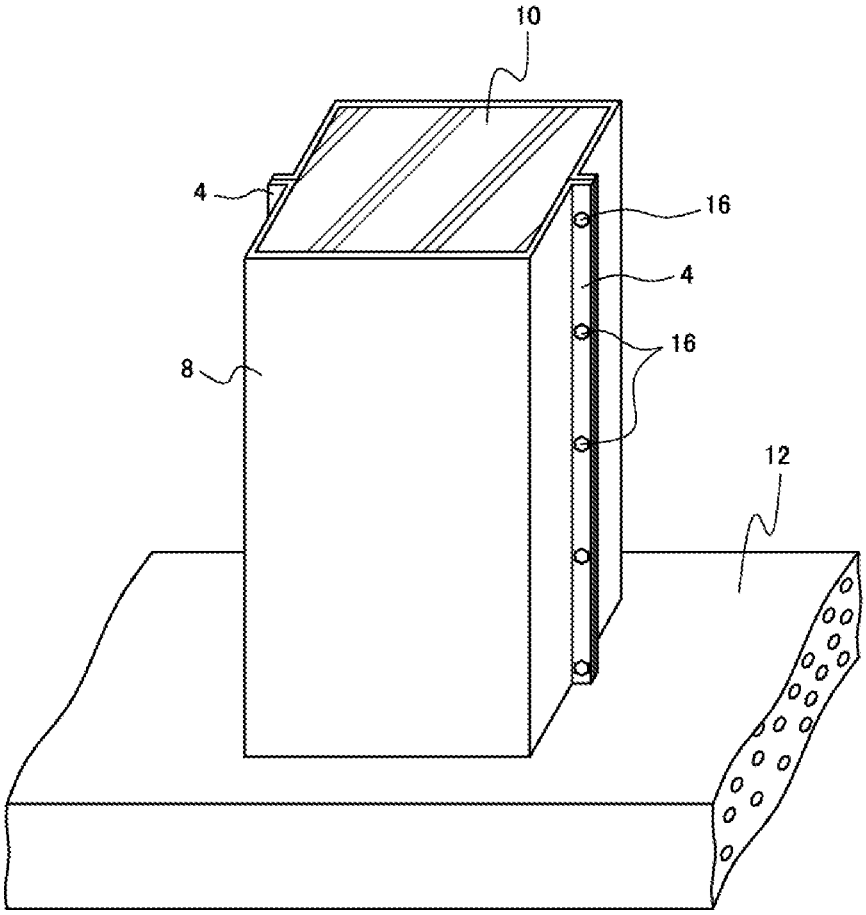

[Fig. 9]
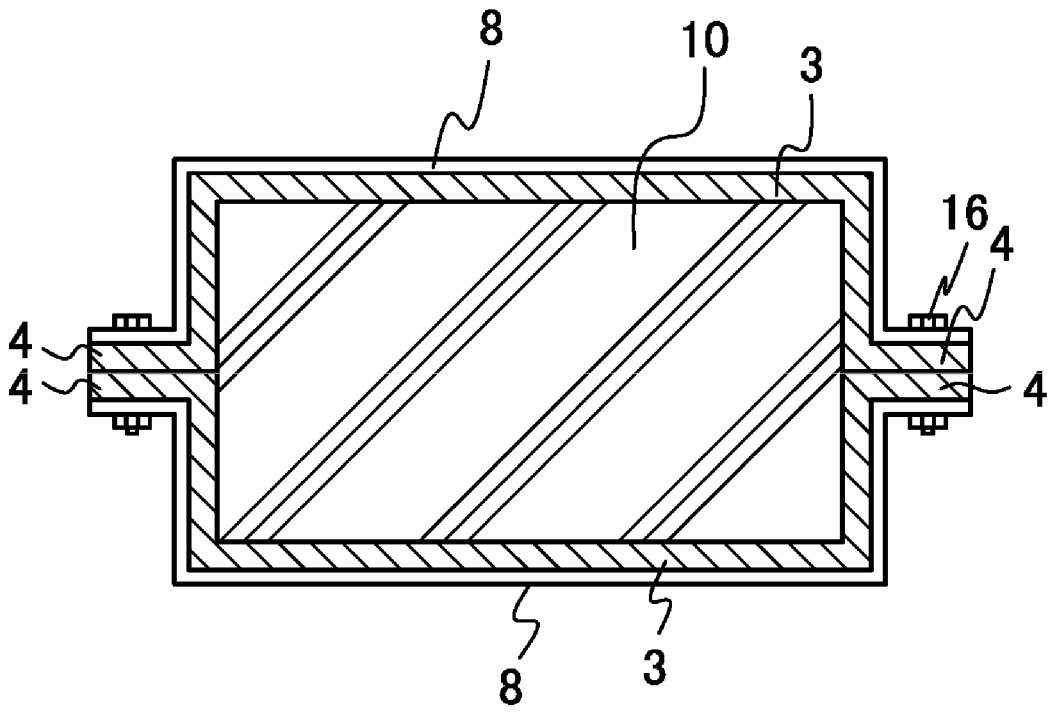

[Fig. 10]
(a)
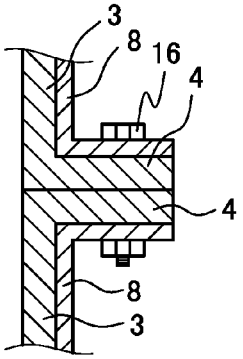
(b)
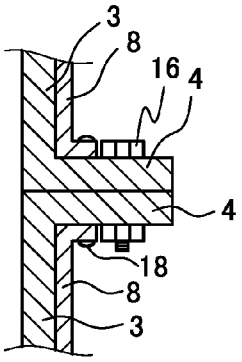
(c)
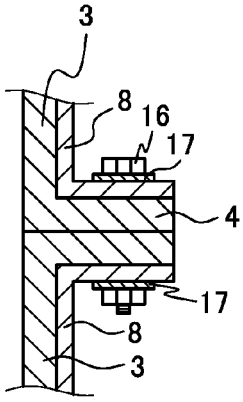
(d)
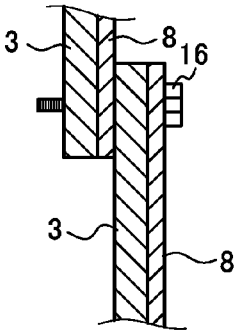
(e)
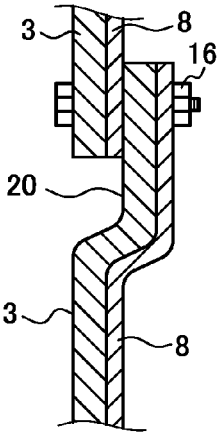

[Fig. 11]
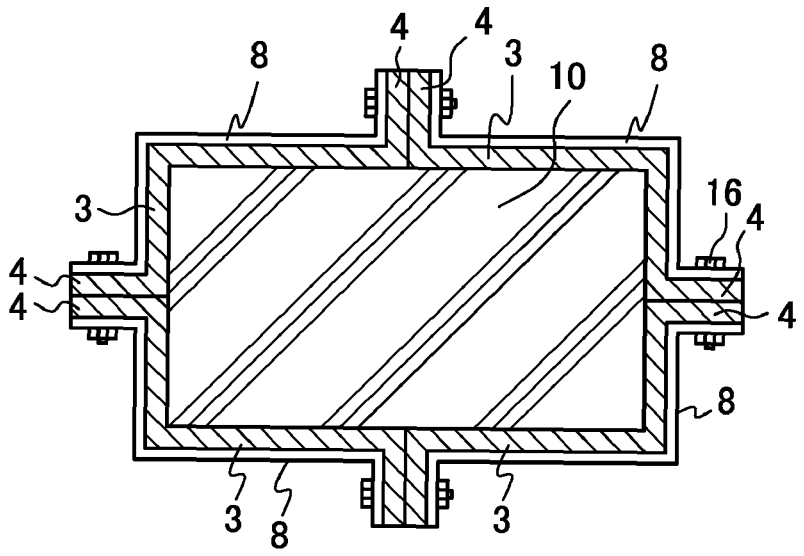
[Fig.12]
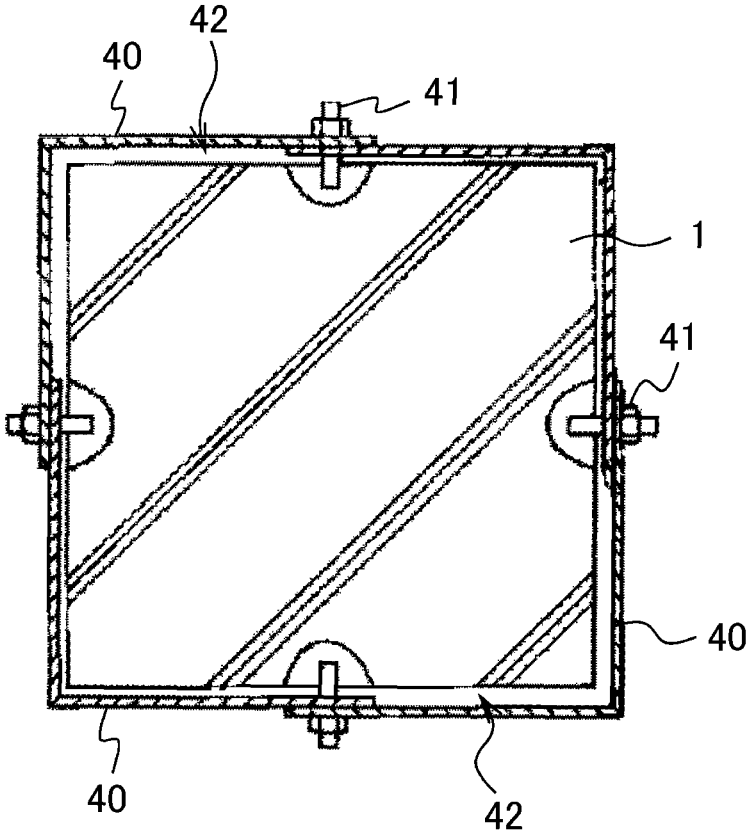

[Fig.13]
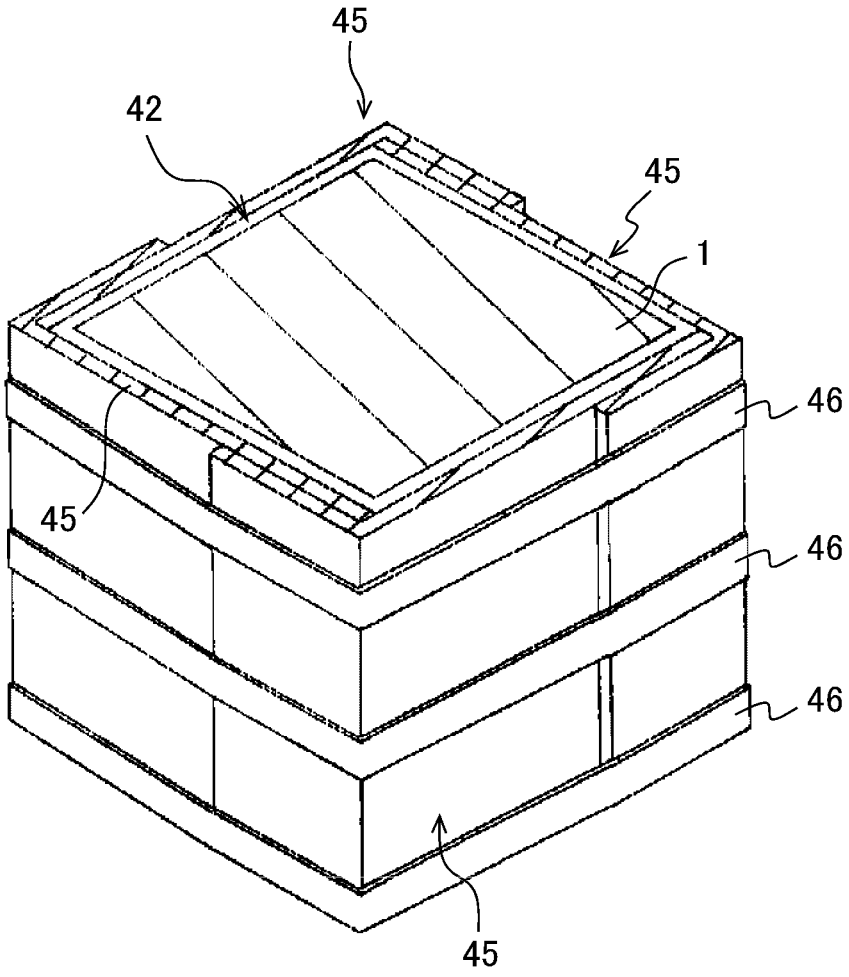

CONSTRUCTION METHOD FOR REINFORCING A COLUMN AND REINFORCING STRUCTURE FOR A COLUMN

TECHNICAL FIELD

The present invention relates to: a construction method for reinforcing a column subjected to reinforcement under a condition with extremely limited working space and working time, such as the reinforcement of a center pillar of a subway, a column of an overpass or a parking structure, or a column of a building immediately after a disaster; and a reinforcing structure.

BACKGROUND ART

Construction for reinforcing a center pillar in a subway tunnel, a column of an overpass or a parking structure, a column of a building immediately after a disaster, or the like, takes place under a condition with heavily restricted working space and working time.

For example, when reinforcing a center pillar in a subway tunnel, the reinforcement must be implemented in a short period of time at night, outside of operational business hours. Specifically, considering that current flows in the subway tracks for 30 minutes after the current supplied to the tracks is stopped, there are only several daily working hours at night when the trains are stopped, i.e., a construction time of about 3 hours from 1 AM to 4 AM.

In addition, working space is extremely limited, as the space between a center pillar and a train is narrow. Since the working space that can be secured in a subway tunnel is narrow in this manner, heavy machinery or large equipment cannot be used. The same time and spatial limitations are imposed when reinforcing a column of an overpass or a parking structure, or a column of a building site where a disaster has occurred.

Methods for reinforcing a column of a building structure by surrounding the perimeter of the column with a reinforcing material in order to enhance the earthquake resistance of the column have been proposed heretofore.

For example, Japanese Laid-Open Publication No. 9-177334 (Patent Literature 1) discloses a construction method for reinforcing a concrete column. The method of reinforcement disclosed in Patent Literature 1 is a method comprising: disposing a plurality of steel plates 40 so as to surround a concrete column 1; overlaying end sections of adjacent steel plates 40 and coupling the end sections with a bolt/nut 41; and filling a space 42 between the concrete column 1 and the steel plate 40 with grout as shown in FIG. 12.

Further, Japanese Laid-Open Publication No. 2005-23745 (Patent Literature 2) also discloses a construction method for reinforcing a concrete column. The method of reinforcement disclosed in Patent Literature 2 is a method comprising: disposing steel plates 45 with a cross-section formed in an L-shape on the four corners of a concrete column 1 so as to surround the concrete column 1; binding the steel plates 45 by wrapping a belt-like fiber sheet 46 on the outer perimeter of the steel plates 45; and filling a space 42 between the four steel plates 45 and the concrete column 1 with grout as shown in FIG. 13.

However, the curing period required for grout filled into the space between the concrete column and steel plates to solidify is long in these construction methods for reinforcement. Thus, the methods of reinforcement disclosed in these Patent Literatures cannot be employed as a method of reinforcement under a condition where reinforcement work must be implemented in a short period of time as in the above-described case of reinforcing a center pillar of a subway tunnel. In addition, since these methods of reinforcement require the use of injection equipment for injecting grout into the space between a pillar and a steel plate in a narrow working space, work at a construction site would be extremely difficult.

As a method for reinforcing a column subjected to reinforcement (e.g., concrete column) without using grout, the inventors investigated a method comprising disposing a plurality of steel plates in a transverse direction so as to surround the perimeter of a column subjected to reinforcement and wrapping a belt-like fiber sheet thereon while applying an adhesive to the outer circumferential surface of the steel plates. Since this method does not use grout, work can be carried out expeditiously, in addition to the level of earthquake resistance being equivalent in comparison to a case of using grout (e.g., see Non-Patent Literature 1: this document studies the level of earthquake resistance capability of a reinforcing steel plate using mortar, which is also grout). However, a fair amount of curing time is required for the applied adhesive to sufficiently function as an adhesive. For this reason, it would be difficult to quickly and efficiently complete reinforcement work within a limited working time. Even when the amount of adhesive applied was increased to further enhance the adhesiveness, the adhesive dripped down until the adhesive suitably cured, and time and effort were required to remove the adhesive which dripped down onto the ground or floor.

CITATION LIST

Patent Literature

[PTL 1] Japanese Laid-Open Publication No. 9-177334
[PTL 2] Japanese Laid-Open Publication No. 2005-23745

Non Patent Literature

[NPL 1] 51st Annual Conference of the Japan Society of Civil Engineers, (September 1996), V-529, "EXPERIMENTAL STUDY ON STEEL BOARD ROLLING REINFORCEMENT FOR RC ELEVATED BRIDGE COLUMN", p 1056-1057, Central Japan Railway Company member, Hiroshi TAHATA, Railway Technical Research Institute member, Tsutomu SATO, Railway Technical Research Institute member, Tadatomo WATANABE, Railway Technical Research Institute member, Makoto YASUHARA

SUMMARY OF INVENTION

Technical Problem

The construction methods for reinforcement in which a belt-like fiber sheet is wrapped around steel plates surrounding a column subjected to reinforcement requires wrapping belt-like fiber sheets two or three times around the steel plates while applying an adhesive to the steel plates in order to enhance the column strength with the belt-like fiber sheets. However, it was found that it was not possible to prevent the adhesive from dripping down from the sheets at the time of application. Accordingly, the amount of adhesive that should have been retained by the belt-like fiber sheet became insufficient, resulting in insufficient strength.

For example, in order to impart sufficient strength, it is necessary to provide 300 g/m$^2$ of adhesive for each belt-like fiber sheet. However, it was found that when a sheet was wrapped around steel plates while adhesive was applied to the steel plates at a construction site, the adhesive dripped down so that only about 200 g/m$^2$ of adhesive was retained for each belt-like fiber sheet.

In addition, the floor surface of a subway tunnel would be dirtied by an adhesive that drips down from a belt-like fiber sheet, as described above, upon application of the adhesive to the belt-like fiber sheet. The dirtied floor surface due to the adhesive would need to be cleaned. However, since construction time is limited as described above, the floor surface cannot be cleaned.

The present invention has been conceived to solve the above-described problem. The objective of the present invention is to provide: a construction method for reinforcing a column which enables reinforcement work on the column subjected to reinforcement in a simple and efficient manner under a condition with extremely limited working space and working time; and a reinforcing structure of a column.

Solution to Problem

The present invention has the following features in order to solve the above-described problem.

A construction method for reinforcing a column according to the present invention comprises the steps of: disposing a steel plate around the column subjected to reinforcement; and wrapping a reinforcement sheet impregnated with an adhesive on an outer surface of the steel plate, thereby achieving the objective described above.

Preferably, a plurality of the steel plates are disposed on the column subjected to reinforcement in a vertical direction.

Preferably, the reinforcement sheet is wrapped around the column subjected to reinforcement with the steel plate interposed therebetween in a transverse direction.

Preferably, the steel plate surrounds the column subjected to reinforcement in a form divided into a plurality of steel plates.

Preferably, the reinforcement sheet is wrapped around so that an end surface, where wrapping ends, of the one reinforcement sheet is at a different location in a circumferential direction of the column subjected to reinforcement from an end surface, where wrapping ends, of another reinforcement sheet adjacent in a vertical direction.

Preferably, an end surface created from dividing the surrounding steel plate overlaps with an end surface of an adjacent divided steel plate in a vertical direction.

Preferably, a sheet impregnated with an adhesive is fabricated in advance such that an amount of adhesive with which the reinforcement sheet is impregnated is 250 g/m$^2$ to 350 g/m$^2$, and the reinforcement sheet is then carried into a construction site.

Preferably, the step of applying grout to a wall surface around the column subjected to reinforcement to flatten the wall surface before the step of disposing the steel plate on the wall surface is further comprised.

Preferably, the step of applying grout to a wall surface surrounding the column subjected to reinforcement to flatten the wall surface after the step of disposing the steel plate on the wall surface is further comprised.

A reinforcing structure of a column according to the present invention comprises: a steel plate disposed around the column subjected to reinforcement; and a reinforcement sheet impregnated with an adhesive, the sheet being wrapped a plurality of times around an outer surface of the steel plate, thereby achieving the objective described above.

Preferably, a plurality of the steel plates are disposed on the column subjected to reinforcement in a vertical direction.

Preferably, the reinforcement sheet is wrapped around the column subjected to reinforcement with the steel plate interposed therebetween in a transverse direction.

Preferably, the steel plate surrounds the column subjected to reinforcement in a form divided into a plurality of steel plates.

Preferably, the reinforcement sheet is wrapped around so that an end surface, where wrapping ends, of the one reinforcement sheet is at a different location in a circumferential direction of the column subjected to reinforcement from an end surface, where wrapping ends, of another reinforcement sheet adjacent in a vertical direction.

Preferably, an end surface created from dividing the surrounding steel plate overlaps with an end surface of an adjacent divided steel plate in a vertical direction.

Preferably, an amount of adhesive with which the reinforcement sheet is impregnated is 250 g/m$^2$ to 350 g/m$^2$.

Preferably, grout is applied to a wall surface around the column subjected to reinforcement.

Advantageous Effects of Invention

According to the construction methods for reinforcement of the present invention, a reinforcement sheet impregnated with an adhesive is wrapped around the outer surface of a steel plate. Thus, work to wrap a sheet impregnated with an adhesive around a steel plate can be completed with only fabricating a sheet impregnated with an adhesive at a factory or the like and carrying the sheet impregnated with an adhesive to a construction site to wrap the sheet around a steel plate at the site. Thus, work to attach a reinforcement sheet to the outer surface of a steel plate with an adhesive at a construction site is unnecessary, so that the time for applying an adhesive at a construction site can be omitted.

In addition, since adhesive is not applied to the outer surface of a steel plate or a sheet as in the conventional techniques, adhesive does not drip down at the construction site to make the floor surface of the construction site dirty because the adhesive has reasonably cured to exert a suitable adhesiveness.

Furthermore, since it is possible to impregnate and impart a reinforcement sheet with a suitable amount of adhesive, there is no risk of a decrease in strength due to insufficient adhesive. In addition, adhesive would not drip down at the construction site. Accordingly, it is possible to reduce the number of times reinforcement sheets are wrapped around in comparison to a case of applying sheets while applying an adhesive at a construction site. If anything, strength would not be insufficient, for example, with a double wrapping of sheets in the present invention although conventional construction methods of reinforcement require triple wrapping.

According to the reinforcing structure of the present invention, the structure comprises a steel plate disposed around a column subjected to reinforcement and a reinforcement sheet impregnated with an adhesive, which is wrapped a plurality of times around the outer surface of the steel plate. Thus, a reinforcement sheet in which the adhesive has cured constrains the column subjected to reinforcement from the outside, with the steel plate interposed therebetween. Therefore, the earthquake resistance of a column can be improved.

A columnar surface of a column subjected to reinforcement is not necessarily formed having a flat surface. For this reason, a steel plate applied to the columnar surface cannot stably contact the columnar surface. It is possible to flatten the surface by applying a method, such as applying grout to a columnar surface, such that both surfaces are efficiently in contact.

BRIEF DESCRIPTION OF DRAWINGS

FIG. 1 is a vertical schematic cross-sectional view showing the inside of a subway structure.

FIG. 2 is a schematic transverse cross-sectional view of a center pillar portion in a subway structure in one Example of the present invention.

FIG. 3 is a perspective view of a center pillar portion shown in FIG. 2.

FIG. 4 is a diagram for illustrating a construction method for reinforcing the center pillar shown in FIG. 3.

FIG. 5 is a vertical cross-sectional view of an essential part of the center pillar shown in FIG. 3.

FIG. 6 is a schematic transverse cross-sectional view of a center pillar. FIG. 6(*a*) shows an example of wrapping one layer of reinforcement sheet around the outer surface of a steel plate in an L shape. FIG. 6(*b*) shows an example of wrapping one layer of reinforcement sheet around the outer surface of a steel plate in a U shape. FIG. 6(*c*) shows an example of wrapping two layers of reinforcement sheets around the outer surface of a steel plate in an L shape.

FIG. 7 is a schematic transverse cross-sectional view of a center pillar portion in a subway structure in yet another Example of the present invention.

FIG. 8 is a perspective view of the center pillar portion shown in FIG. 7.

FIG. 9 is a schematic transverse cross-sectional view of the center pillar shown in FIG. 9.

FIG. 10 FIGS. 10(*a*)-(*e*) each show a cross-sectional view of various forms of a coupling portion at the end sections of steel plates.

FIG. 11 is a cross-sectional view of a center pillar in yet another Example of the present invention.

FIG. 12 is a cross-sectional view of a conventional reinforcing structure of a concrete column.

FIG. 13 is a perspective view of another conventional reinforcing structure of a concrete column.

DESCRIPTION OF EMBODIMENTS

Hereinafter, the embodiments of the present invention are explained in detail while referring to the drawings.

The present invention can be applied to a construction method for reinforcing a column subjected to reinforcement, such as reinforcing a center pillar of a subway tunnel, a column of an overpass or a parking structure, or a column of a building immediately after a disaster, under conditions with extremely limited working space and working time.

A column subjected to reinforcement as referred herein includes reinforced concrete columns, steel framed reinforced concrete columns, concrete filled steel tube columns, and steel columns.

Hereinafter, a column reinforcing method for reinforcing a concrete center pillar in a subway tunnel and a column reinforcing structure are explained as examples of embodiments of the present invention.

Embodiment 1

FIG. 1 is a schematic vertical cross-sectional view of a subway structure (inside a subway tunnel), FIG. 2 is a schematic transverse cross-sectional view of a center pillar portion in the subway structure, and FIG. 3 is a perspective view of the center pillar portion thereof.

As shown in FIGS. 1-3, for example, a plurality of center pillars 10 are erected on a bottom floor board 12 for dividing a train track (railway) in one direction and a train track (railway) in the opposite direction 14 at predetermined intervals along the railways in a subway structure.

The center pillars 10 are formed such that the transverse cross-section has, for example, a square shape. A steel plate 3 is disposed around the center pillar 10 so as to surround the center pillar 10. One or a plurality of steel plates 3 can be disposed on the center pillar 10 in the vertical direction (upright direction). Further, the steel plate 3 can surround the center pillar 10 with one plate or in a form divided into a plurality of plates. In this Embodiment, for example, four steel plates 3 (the number of steel plates is not represented in the drawing as the plates are hidden by the reinforcement sheet) are disposed to surround the center pillar 10.

For example, a relatively thin steel plate with a thickness of about 1.6 mm is used as the steel plate 3. The periphery of a column subjected to reinforcement may be directly covered with a single steel plate. However, a steel plate formed by dividing the plate into a plurality of plates and bending the plates to give an L-shaped transverse cross section can also be used. The plate-like section on one side and the plate-like section on the other side, with a corner section of the steel plate 3 formed into an L-shape therebetween, may have the same or different lengths. Since such a thin steel plate 3 is light, the steel plate 3 can be carried by hand to a construction site in a subway structure without the use of heavy machinery.

As shown in FIG. 4(*a*), each steel plate 3 is disposed to surround a corner section of the center pillar 10. An end surface created by dividing the surrounding steel plate 3 overlaps with an end surface of the adjacent divided steel plate 3 in the vertical direction. That is, an end section of each divided steel plate 3 surrounding the center pillar 10 extends along the wall surface of the center pillar 10 and end sections thereof overlap on the wall surface. In this manner, an end section of one of the divided steel plates 3 overlaps an end section of the other, adjacent divided steel plate 3 in the transverse direction (in the circumferential direction around the center pillar).

As shown in FIG. 5, the steel plate 3 is disposed on the outer side of the center pillar 10 such that at least a portion of the inner surface of the steel plate 3 contacts the outer surface of the center pillar 10.

Next, a reinforcement sheet 8 impregnated with an adhesive is wrapped around the outer surface of the steel plate 3. Naturally, the sheet 8 can be wrapped around the outer surface of the adjacent steel plate 3 in the columnar vertical direction while extending out from the outer surface of the steel plate 3.

The reinforcement sheet 8 is an adhesive-impregnated fiber sheet having numerous fibers.

Fibers that can be used in a fiber sheet include carbon fiber, glass fiber, aramid fiber, polyethylene fiber, and vinyl on fiber. These fibers can be used individually or as a combination of multiple types of fibers. Aramid fibers are preferable in terms of price and in terms of having excellent properties such as tensile strength. A fiber sheet can be used in a single-layer form or in a two or more layer form.

In order to impregnate such a fiber sheet with an adhesive, the adhesive can be applied to a fiber sheet with a brush or a roller in a factory. Alternatively, the fiber sheet can be impregnated with adhesive by immersing the sheet in a container containing the adhesive in a factory. A sheet can be impregnated with a desired amount of adhesive in accordance with such methods of adhesive impregnation. Further, when sheets are impregnated with an adhesive in a factory, the sheets can be impregnated with nearly a constant amount of adhesive. Specifically, since the temperature in a factory is almost constant, the viscosity of the adhesive would be constant regardless of the season. For this reason, the amount of adhesive a sheet is impregnated with would not vary significantly depending on the season.

The type of adhesive for impregnating a fiber sheet is not limited, but use of an adhesive such as an epoxy adhesive, methacrylic adhesive, or acrylic adhesive is preferable.

Adhesives that cure at normal temperature are particularly preferable. A two-component type adhesive, which is an adhesive that starts curing by mixing a main agent with a curing agent that are both made of synthetic chemical components, and a one-part type adhesive can both be used. However, use of a two-component type adhesive is preferable for there are generally more two-component type adhesives with higher adhesive strength, or, that is to say, two-component type adhesives are more reliable with respect to securing a predetermined adhesive strength.

The amount of adhesive with which a fiber sheet is impregnated is preferably 250 $g/m^2$ to 350 $g/m^2$, more preferably 280 $g/m^2$ to 330 $g/m^2$, and particularly preferably 290 $g/m^2$ to 310 $g/m^2$.

When the amount of impregnating adhesive is much less than 250 $g/m^2$, the strength of adhesion of the reinforcement sheet 8 to the steel plate 3 tends to decrease. Even if the amount of adhesive impregnated exceeded 350 $g/m^2$, the adhesive strength would not increase much. However, the weight would increase and the material cost would be higher.

In this manner, the reinforcement sheet 8 is fabricated by impregnating a fiber sheet in advance with a predetermined amount of adhesive in a factory. The adhesive is reasonably cured to come to have a strong adhesive capability. The time required for reasonable curing thereof is 2 to 3 hours based on outside air temperature of 20° C. The viscosity of adhesives differs depending on the type and manufacturer of the adhesive. For this reason, manufactures have prepared adhesives with two types of viscosity, i.e., for summer and for winter. Thus, an adhesive with a suitable viscosity can be used.

The sheet impregnated with an adhesive (reinforcement sheet) 8 is carried into an implementation site. The reinforcement sheet 8 is then wrapped around the outer surface of the steel plate 3 disposed around the center pillar 10.

The reinforcement sheet 8 may be wrapped around the center pillar 10 with the steel plate 3 interposed therebetween in a slightly slanted state. However, the reinforcement sheet 8 is generally wrapped around the center pillar 10 with the steel plate 3 interposed therebetween in the transverse direction (horizontal direction). That is, one or a plurality of reinforcement sheets 8 are wrapped around the columnar surface with the steel plate 3 interposed therebetween such that the longitudinal direction of fibers included in the reinforcement sheet 8 almost matches the circumferential direction of the center pillar 10 (direction orthogonal to the axial direction of the center pillar).

It is preferable that an end surface, where wrapping ends, of one reinforcement sheet 8 wrapped around the center pillar 10 overlaps an end surface, where wrapping begins, of the reinforcement sheet 8.

As shown in FIG. 4(*b*), when a plurality of reinforcement sheets 8 are wrapped around the perimeter of the center pillar 10, the plurality of reinforcement sheets 8, 8 are wrapped around the perimeter of the center pillar 10 such that end sections of adjacent reinforcement sheets 8 overlap each other. For example, as shown in FIG. 6(*a*), a first reinforcement sheet 8*a* is wrapped around the columnar surface with the steel plate 3 interposed therebetween, and then a second reinforcement sheet 8*b* adjacent to the first reinforcement sheet 8 is wrapped around the columnar surface with the steel plate 3 interposed therebetween such that an end section of the second reinforcement sheet 8*b* overlaps an end section of the first reinforcement sheet 8*a*.

The shape and size of the reinforcement sheet 8 is not limited. For example, a belt-shaped reinforcement sheet or a rectangular reinforcement sheet can be used.

The length of the reinforcement sheet 8 in the circumferential direction of the central pillar 10 can be appropriately set in accordance with the length of the perimeter of the central pillar 10. For example, the length of the reinforcement sheet 8 can be greater than or equal to the width of the center pillar 10. The reinforcement sheet 8 wrapped around a columnar surface with the steel plate 3 interposed therebetween is preferably wrapped around in a form with an L-shape transverse cross-section (FIG. 6(*a*)) or a U-shape transverse cross-section (FIG. 6(*b*)). The reinforcement sheet 8 is preferably wrapped around the outer surface of the steel plate 3 so as to span across a first steel plate 3 and a second steel plate 3 that are adjacent in the circumferential direction of the center pillar 10 from the viewpoint of strength. The width in the vertical direction (upright direction of the center pillar) of the reinforcement sheet 8 is determined while taking into consideration the ease of handling of a reinforcement sheet or the like. The width may be of any size as long as the reinforcement sheet 8 can be readily transported.

After the reinforcement sheet 8 is wrapped around the columnar surface with the steel plate 3 interposed therebetween, an adhesive with which the reinforcement sheet 8 is impregnated cures. Thus, the plurality of reinforcement sheets 8 are integrated, so that the reinforcement sheets 8 are secured to the center pillar 10 with a plurality of the steel plates 3 interposed therebetween.

As shown in FIGS. 3 and 4(*b*), when a plurality of the reinforcement sheets 8 are wrapped around the center pillar 10 in the vertical direction (upright direction), the reinforcement sheet 8 is wrapped around so that an end surface, where wrapping ends, of one reinforcement sheet 8 would be at a different location from an end surface of another reinforcement sheet 8 adjacent in the vertical direction. Thus, an overlapping section of end sections of one reinforcement sheet 8 positioned on the top side of the center pillar 10 is different in the circumferential direction of the center pillar 10 from an overlapping section of end sections of the reinforcement sheet 8 positioned adjacent in the lower side of said reinforcement sheet 8. This is a matter of course in terms of effectively imparting strength.

As shown in FIGS. 4(*b*), 6(*a*), and 6(*b*), the reinforcement sheet 8 may be wrapped around in one layer, or as shown in FIG. 6(*c*), the reinforcement sheet 8 may be wrapped around in two layers. Indeed, the reinforcement sheet 8 may be wrapped around in more layers.

When the reinforcement sheet 8 is wrapped around the columnar surface with the steel plate 3 interposed therebetween in two layers, a second layer of reinforcement sheet 8 (top layer of reinforcement sheet) is wrapped on top of a first layer of reinforcement sheet 8 (lower layer of reinforcement sheet). It is preferable that the second layer of reinforcement sheet 8 is wrapped on top of the first reinforcement sheet 8 such that an overlapping section 81 of adjacent first layer reinforcement sheets 8 and an overlapping section 82 of adjacent second layer reinforcement sheets 8 are offset in the circumferential direction of the center pillar 10.

In this manner, the overlapping sections 81 and 82 of reinforcement sheets 8 are offset in the circumferential direction of the center pillar 10 so that the thickness of the reinforcement sheet 8 over the entire circumference is nearly the same and the strength thereof is uniform.

The reinforcement sheet 8 may be temporarily secured while the reinforcement sheet 8 is pressed onto the outer surface of the steel plate 3 by using a pressing jig for pressing the sheet 8 from the outside.

It is possible to apply exterior finishing, such as painting, finishing mortar, or tiling, on the outer surface of a reinforcement sheet 8 that has been wrapped around as needed.

For the reinforcement sheet 8, a fiber sheet is impregnated with a predetermined amount of adhesive in advance, and the sheet would not be impregnated with an adhesive at a construction site. Thus, the reinforcement sheet 8 has excellent workability. In addition, since the adhesive is in a semi-cured state such that the adhesive does not drip down from the fiber sheet when the reinforcement sheet 8 is carried, the adhesive would not dirty the floor surface by dripping down from the steel plate 3 or the reinforcement sheet 8 when applied.

As shown in FIG. 5, when there is unevenness on the surface of the center pillar 10, the inner surface of the steel plate 3 contacts only the protruding sections on the surface of the center pillar 10 when the steel plate 3 is disposed on the outer surface of the center pillar 10. Thus, a gap 11 is created between the outer surface of the center pillar 10 and the steel plate 3. In order to enhance the reinforcing function of the reinforcement sheet 8, grout 6 is applied to the gap 11 created between the center pillar 10 and the steel plate 3 to allow the wall surface of the center pillar 10 to contact the steel plate surface at high efficiency. With such application, the surface of the center pillar 10 becomes flat and the steel plate 3 is stably disposed on the center pillar 10, whereby the reinforcing function of the reinforcement sheet 8 is enhanced.

The grout 6 is applied to the surface of the center pillar 10 or injected into the gap 11 created between the center pillar 10 and the steel plate 3 before or after disposing the steel plate 3 around the center pillar 10.

When the grout 6 is applied to the surface of the center pillar 10 before disposing the steel plate 3 around the center pillar 10, a tool such as a brush or trowel may be used to apply the grout 6 to the surface of the center pillar 10. In order to fill the gap 11 between the center pillar 10 and the steel plate 3 with the grout 6, the grout 6 is injected from a hole opened in the steel plate 3. Upon injection, the steel plate 3 is temporarily secured to the center pillar 10 with a pin or the like to hold the steel plate 3 to the center pillar 10.

In such a construction method for reinforcing the center pillar 10, the entire circumference of the center pillar 10 is surrounded by a plurality of steel plates 3, 3, and a plurality of reinforcement sheets 8 are applied to the columnar surface with the plurality of steel plates 3, 3 interposed therebetween by an adhesive impregnated in advance. The plurality of reinforcement sheets 8 are integrated in a state where the adhesive is solidified. Accordingly, since the reinforcement sheet 8 constrains the movement of the entire center pillar 10 via the steel plate 3, the earthquake resistance of the center pillar 10 can be enhanced.

The plurality of steel plates 3 are secured to the center pillar 10 by the reinforcement sheet 8. Thus, there is no need for welding the steel plates 3 together or coupling the plates with a coupling tool. Hence, the steel plate 3 is readily secured to a column.

Further, the reinforcement sheet 8 has a predetermined dimension. Thus, the reinforcement sheet can be readily transported to a construction site. The reinforcement sheet 8 is impregnated with an adhesive. Further, work to wrap the reinforcement sheet 8 onto a column is simple and the adhesive would not drip down from the sheet upon wrapping.

The reinforcement sheet 8 is wrapped around a columnar surface with the steel plate 3 interposed therebetween. Thus, even if the surface of a column has unevenness, the outward appearance of the reinforcement sheet 8 would be flat so the aesthetics would not be ruined.

In the above-described Embodiment, four steel plates were disposed around a column subjected to reinforcement in the vertical direction of the column subjected to reinforcement. However, the number of steel plates disposed around a column is not limited thereto. One or two or more steel plates can be disposed around a column. It is preferable that a steel plate is divided into two or more plates for use to be able to adapt to columns with different sizes. Furthermore, the transverse cross-sectional shape created upon dividing the steel plate is not limited to an L-shape. A steel plate with a U-shaped transverse cross-sectional shape can also be used.

Embodiment 2

In the above-described Embodiment 1, a plurality of steel plates were disposed around the center pillar 10 such that an end surface created from dividing a surrounding steel plate overlaps with an end surface of an adjacent divided steel plate in the vertical direction. However, in Embodiment 2, a plurality of steel plates 3 are disposed around a center pillar 10 by coupling end sections of adjacent steel plates 3, 3 with each other with a fastener 16.

The details thereof are as follows.

As shown in FIGS. 7-9, two steel plates 3, 3 are disposed around the center pillar 10 with, for example, a square shape transverse cross-section so as to surround the center pillar 10.

Steel plates that are formed by bending a relatively thin steel plate with a thickness of about 1.6 mm in a U-shaped transverse cross-section can be used as the steel plate 3.

A coupling section 4 for coupling a pair of steel plates 3 to each other is formed at both ends of the steel plate 3. In this embodiment, the coupling section 4 is formed by bending both ends of the steel plate 3 outward as shown in FIGS. 9 and 10(*a*). One or more throughholes for allowing a fastener 16 such as a screw or a bolt may be formed on the coupling section 4. As shown in FIG. 10, the coupling section 4 provided on the end section of the steel plate 3 is formed to be long in the upright direction of the center pillar 10.

Next, a reinforcement sheet 8 impregnated with an adhesive with a predetermined length is pressed onto the outer surface of the steel plate 3 to apply the reinforcement sheet 8 to the outer surface of the steel plate 3.

The reinforcement sheet 8 is a belt-like fiber sheet consisting of numerous long fibers extending in one direction, which is impregnated with an adhesive.

The sheet impregnated with an adhesive (reinforcement sheet) 8 is carried into an implementation site. The reinforcement sheet 8 is then applied to the outer surface of the steel plate 3 disposed around the center pillar 10.

The end sections of adjacent steel plates 3, 3 are then coupled to each other. It is sufficient for the coupling thereof to bring together each of the coupling sections 4, 4 formed on the end sections of the adjacent steel plates 3, 3 and couple both of the coupling sections 4, 4 with the fastener 16 such as a screw or a bolt/nut.

When coupling the end sections of steel plates 3 to each other, as shown in FIG. 9 and FIG. 10(*a*), the end section of the reinforcement sheet 8 may be extended up to the end section of the steel plate 3, and the end section of the reinforcement sheet 8 may be secured to the end section of the steel plate 3 while coupling the pair of steel plates 3, 3 with the fastener 16.

Furthermore, as shown in FIG. 10(*b*), the end sections of adjacent steel plates 3, 3 may be directly coupled to each other with the fastener 16. In this case, the end section of the sheet 8 does not extend up to the end section of the steel plate 3. The end section of the reinforcement sheet 8 is secured to the end section of the steel plate 3 with a fastener 18 in a separate process from the work to couple the pair of steel plates 3, 3 with the fastener 16.

As shown in FIG. 10(*c*), a washer plate 17 that is long in the up and down directions may be provided on the outside of the reinforcement sheet 8, and the end section of the steel plate 3 and the end section of the sheet 8 may be coupled with the fastener 16 so as to hold down the reinforcement sheet 8 with the washer plate 17.

Furthermore, as shown in FIG. 10(*d*) and FIG. 10(*e*), the coupling may be configured such that each of the end sections of adjacent steel plates 3, 3 extends towards the opposite direction from each other, and the steel plates 3, 3 and the sheets 8, 8 are coupled by the fastener 16 while stacking the end sections of the steel plates 3, 3 and sheets 8, 8. The embodiment shown in FIG. 10(*e*) is configured such that the end section of one of the steel plates 3 is bent to form a step section 20 so that the end section of the other steel plate 3 can be inserted in the step section 20. Further, in this example, a large hole into which a bolt head can be inserted and a small long slotted hole in communication with the large hole are formed on the steel plate 3 disposed inside. The bolt head is passed through the large hole and the bolt is then shifted along the long slotted hole to pass the bolt base section through the through hole of the steel plate 3 on the outside.

Further, in the Embodiments shown in FIG. 10(*d*) and FIG. 10(*e*), a hole for allowing a fastener 16 such as a bolt to pass through is formed as a long slotted hole. The steel plates 3, 3 secured with the fastener 16 are enabled to slide and move within the long slotted hole to be able to handle a wider range of shaking of a column due to vibrations.

Examples of forms of the reinforcement sheet 8 applied to the steel plate 3 includes the following.

For the reinforcement sheet 8, a plurality of sheets 8 with a predetermined width and a predetermined length that is long in the horizontal direction (direction of fibers is along the longitudinal direction of the sheet) may be prepared and applied to the outer surface of the steel plate 3 so that there are a plurality of rows at the top and bottom. Alternatively, the sheet 8 that is long in the vertical direction with a predetermined length may be applied to the entire outside surface of the steel plate 3. The reinforcement sheet 8 may be applied to the outside surface of the steel plate 3 in a single layer or in two or more layers.

In such a construction method for reinforcing the center pillar 10, the entire circumference of the center pillar 10 is surrounded by a plurality of steel plates 3, 3 and the end sections of the steel plates 3, 3 are coupled to each other. Furthermore, the steel plates 3 surrounding the center pillar 10 are surrounded by the reinforcement sheets 8, 8, and the end sections of the reinforcement sheet 8 are coupled to each other via the end sections of the steel plates 3. Accordingly, since the center pillar 10 is reinforced with the steel plate 3 and the reinforcement sheet 8, the rigidity of the steel plate 3 and the property of the reinforcement sheet 8 are imparted thereto. As a result, the earthquake resistance of the center pillar 10 can be enhanced.

As shown in FIG. 11, the configuration may be such that four steel plates 3 with an L-shaped cross section are each disposed at a corner section of a center pillar 10, and coupling sections 4 provided on both end sections of each steel plate 3 are in contact with coupling sections 4 of an adjacent steel plate 3. The coupling sections 4, 4 are coupled with a fastener 16. In Embodiment 2, the weight of the steel plate 3 is further reduced to further facilitate carrying of the steel plate 3 to a construction site.

In the above-described Embodiment, an example of fabricating a sheet impregnated with an adhesive at a factory and applying the sheet on the outer surface of a steel plate at a construction site has been shown. However, it is also possible to apply a sheet impregnated with an adhesive on the outer surface of a steel plate at a factory to fabricate a composite material in which the steel plate and the sheet impregnated with an adhesive are laminated, and to carry the composite material into a construction site and couple the material to the perimeter of a column.

In the above-described Embodiments, a center pillar of a subway has been explained as the column subjected to reinforcement. However, the present invention is not limited to center pillars. In addition to reinforcement of a center pillar of a subway, the present invention can be optimally implemented for reinforcing, for example, columns for an overpass, parking structure, building or a column immediately after a disaster.

In the above-described Embodiments, the cross-sectional shape of a center pillar is square. However, the present invention is applicable even if the center pillar is a polygonal column other than a square column (e.g., octagonal column, hexagonal column etc.), cylindrical column or the like. In this case, a steel plate is formed into a shape conforming to the external shape of a column. It is also possible to divide a steel plate into a plurality of upper and lower pieces and couple the upper and lower plate pieces to install each of the divided steel plate pieces around a column.

INDUSTRIAL APPLICABILITY

The present invention provides: a construction method for reinforcing a column subjected to reinforcement under a condition where reinforcement of a column subjected to reinforcement, such as a center pillar of a subway tunnel, a support column of an overpass or parking structure, or a column of a building immediately after a disaster, must be implemented in a short period of time; and a reinforcing structure.

REFERENCE SIGNS LIST

3 Steel plate
8 Reinforcement sheet
10 Center pillar

The invention claimed is:

1. A construction method for reinforcing a column, comprising the steps of:

disposing a steel plate around the column subjected to reinforcement, the steel plate being disposed such that the steel plate surrounds the column subjected to reinforcement and at least a portion of an inner surface of the steel plate contacts an outer surface of the column subjected to reinforcement;

wrapping a reinforcement sheet impregnated with an adhesive on an outer surface of the steel plate, wherein the portion of the steel plate having the inner surface thereof in contact with the outer surface of the column subjected to reinforcement also has the reinforcement sheet wrapped on the outer surface thereof; and securing the reinforcement sheet to the steel plate by curing the adhesive impregnated into the reinforcement sheet.

2. The construction method for reinforcing a column of claim 1, wherein a plurality of the steel plates are disposed on the column subjected to reinforcement in a vertical direction.

3. The construction method for reinforcing a column of claim 1, wherein the reinforcement sheet is wrapped around the column subjected to reinforcement with the steel plate interposed therebetween in a transverse direction.

4. The construction method for reinforcing a column of claim 1, wherein the steel plate surrounds the column subjected to reinforcement in a form divided into a plurality of steel plates.

5. The construction method for reinforcing a column of claim 1, wherein the reinforcement sheet and another reinforcement sheet adjacent to the reinforcement sheet in a vertical direction are wrapped around the column subjected to reinforcement, so that an end surface of the reinforcement sheet is at a different location from an end surface of the another reinforcement sheet adjacent in the vertical direction in a circumferential direction of the column subjected to reinforcement, wherein the wrapping of the reinforcement sheet ends at the end surface of the reinforcement sheet, and wherein the wrapping of the another reinforcement sheet ends at the end surface of the another reinforcement sheet.

6. The construction method for reinforcing a column of claim 4, wherein an end surface created from dividing the surrounding steel plate overlaps with an end surface of an adjacent divided steel plate in a vertical direction.

7. The construction method for reinforcing a column of claim 1, wherein a sheet impregnated with an adhesive is fabricated in advance such that an amount of adhesive with which the reinforcement sheet is impregnated is 250 $g/m^2$ to 350 $g/m^2$, and the reinforcement sheet is then carried into a construction site.

8. The construction method for reinforcing a column of claim 1, further comprising the step of applying grout to a wall surface around the column subjected to reinforcement to flatten the wall surface before the step of disposing the steel plate on the wall surface.

9. The construction method for reinforcing a column of claim 1, further comprising the step of applying grout to a wall surface surrounding the column subjected to reinforcement to flatten the wall surface after the step of disposing the steel plate on the wall surface.

* * * * *